US006223952B1

(12) United States Patent
Woodford

(10) Patent No.: US 6,223,952 B1
(45) Date of Patent: May 1, 2001

(54) CARTRIDGE FOR HOLDING A SUPPLY OF A FLOWABLE SUBSTANCE

(75) Inventor: Peter Woodford, Canning Vale (AU)

(73) Assignee: Fuchs Lubritech (Australia) Pty. Ltd., Canning Vale (AU)

( * ) Notice: Subject to any disclaimer, the term of this patent is extended or adjusted under 35 U.S.C. 154(b) by 0 days.

(21) Appl. No.: 09/402,217

(22) PCT Filed: Apr. 3, 1998

(86) PCT No.: PCT/AU98/00224

§ 371 Date: Oct. 1, 1999

§ 102(e) Date: Oct. 1, 1999

(87) PCT Pub. No.: WO98/45051

PCT Pub. Date: Oct. 15, 1998

(30) Foreign Application Priority Data

Apr. 4, 1997 (AU) ..... PO6012

(51) Int. Cl.[7] ..... B67D 5/38

(52) U.S. Cl. ..... 222/157; 222/327; 222/541.2; 222/541.9

(58) Field of Search ..... 222/157, 158, 222/159, 156, 154, 153.06, 326, 327, 541.2, 541.9

(56) References Cited

U.S. PATENT DOCUMENTS

| | | | |
|---|---|---|---|
| 1,220,208 | | 3/1917 | Ellis . |
| 1,560,681 | | 11/1925 | Fisher . |
| 1,561,885 | | 11/1925 | Portway . |
| 1,636,407 | | 7/1927 | Brommer . |
| 1,674,542 | | 6/1928 | Clawson . |
| 1,701,788 | | 2/1929 | Metters et al. . |
| 1,849,391 | | 3/1932 | Wharton . |
| 2,031,495 | | 2/1936 | Macklanburg . |
| 2,226,340 | | 12/1940 | Flood . |
| 2,493,891 | | 1/1950 | McCarty . |
| 2,649,999 | * | 8/1953 | Burch ..... 222/327 |
| 2,789,731 | | 4/1957 | Marraffino . |
| 3,481,510 | * | 12/1969 | Allen, Jr. ..... 222/327 |
| 4,522,316 | | 6/1985 | Hoffmann et al. ..... 222/327 |
| 4,776,458 | | 10/1988 | Summons et al. ..... 206/45.31 |
| 5,535,924 | | 7/1996 | Nilsson et al. ..... 222/153.06 |

FOREIGN PATENT DOCUMENTS

| | | |
|---|---|---|
| 4229122 | 3/1994 | (DE) . |
| 4403434 | 10/1994 | (DE) . |
| 2090921 | 7/1982 | (GB) . |

* cited by examiner

*Primary Examiner*—Joseph A. Kaufman
*Assistant Examiner*—Thach H. Bui
(74) *Attorney, Agent, or Firm*—Burr & Brown

(57) ABSTRACT

A cartridge for holding a supply of a flowable substance includes a cylindrical tube which is closed at one end by a slidable seal. An opposite end of the tube is closed by an integral end wall which is provided with a sealed nipple extending from the center thereof. The nipple is provided with an external thread. A line of weakness is formed about the tube near end wall. A flange extends radially from the outer circumferential surface of tube adjacent the line of weakness. A translucent strip is formed along the length of the tube to allow viewing of the position of the slidable seal within the tube. To use the cartridge in a grease gun, the seal is pulled out and the end wall cut off along the line of weakness. To use the cartridge in a caulking gun, the cartridge is simply dropped into the body of the caulking gun and the end of nipple cut off. To use the cartridge in a vacuum gun, the end of nipple is cut off and the nipple is screwed into the vacuum gun.

10 Claims, 1 Drawing Sheet

CARTRIDGE FOR HOLDING A SUPPLY OF A FLOWABLE SUBSTANCE

FIELD OF THE INVENTION

The present invention relates to a cartridge for holding a supply of a flowable substance such as grease, caulking/sealing compounds, adhesives, and the like.

BACKGROUND OF THE INVENTION

There are several types of dispensing devices or guns available for dispensing different types of flowable substance which are marketed in cartridges. One type of dispensing device is the grease gun which for the purposes of this specification and claims is defined as including a cylinder provided with a dispensing screw cap at a first end and a spring biased plunger at an opposite end. The screw dispensing cap is threadingly engaged with the first end of the cylinder and is provided with a lever operated piston valve. The spring biased plunger is biased so as to exert force in a direction from the opposite end toward the first end. The typical cartridge used for holding grease and for use with this grease gun is in the form of a tubular cartridge which is sealed at both ends by removable end plates and has a lip about one end of the cartridge. In use, the dispensing screw cap is unscrewed from the grease gun and the plunger pulled back as far as possible and held in place. The end plates of the grease cartridge are then removed and the cartridge dropped into the cylinder so that the lip rests on the first end of the cylinder. The dispensing screw cap is then screwed back onto the cylinder and the plunger released. The plunger pushes directly on the grease and travels inside the cartridge to force the grease toward the dispensing screw cap. Grease therefore passes into the screw cap and can be dispensed by actuation of the lever operated piston valve.

A second type of dispenser is the caulking gun which for the purposes of the specification and claims is defined as including a semicylindrical housing with a plate at one end for retaining a trigger actuated plunger and a plate at an opposite end provided with a radial extending recess. The caulking gun is typically used to dispense caulking and sealing compounds as well as adhesives which are supplied in cartridges in the form of hollow tubes having a moveable plate sealing one end of the tube and an integral wall at an opposite end. A nipple is form on the integral wall and has an external thread onto which a separate nozzle can be screwed. These cartridges are typical dropped into the housing of the caulking gun between the two plates so that the nipple extends through the radial recess and the plunger is located behind the moveable plate. By squeezing the trigger, the plunger can be advanced toward the nipple pushing on the moveable plate thereby forcing the compound out of the cartridge when the nipple has been cut or otherwise opened.

Another type of dispensing gun is the vacuum gun which for the purposes of this specification and claims is taken as including a lever actuated vacuum mechanism which is provided with a threaded opening for threadingly engaging a nipple of a cartridge holding a flowable substance. The cartridge is in substance identical to the cartridges described above in relation to chalking and sealing compounds and adhesives although often the thread on the nipple may be different. One brand of vacuum dispensing gun is the REINER™ grease gun. When using the vacuum gun, the nipple of the cartridge is cut and then simply screwed into the opening of the lever actuated vacuum mechanism. The lever (or in some cases levers) can then be pumped to create a vacuum which sucks the contents out of the cartridge through the cut nipple. In doing so, the moveable plate at the opposite end of the cartridge slides along an inside wall of the cartridge maintaining a seal.

Notwithstanding any similarities between the cartridges described above, they can not interchangeably be used with different types of dispensing devices. For example, the conventional grease cartridge cannot be used in a caulking gun or in a vacuum gun. Similarly, the cartridge used for caulking guns cannot be used in a conventional grease gun.

SUMMARY OF THE INVENTION

It is an object of the present invention to provide a cartridge for a flowable substance which can be used in a plurality of different dispensing devices.

According to the present invention there is provided a cartridge for holding a supply of a flowable substance, said cartridge adapted for use in a plurality of different dispensing devices which can force said substance from said cartridge, said cartridge including:

- a hollow elongate body for containing a supply of a flowable substance;
- a slidable seal fitted inside said body for sealing one end of said body, an opposite end of said body being closed by an integral wall;
- a sealed nipple formed on said wall and through which said substance can flow when said nipple is cut;
- a line of weakness formed about said body near said opposite end; and,
- means protruding radially from an outer circumferential surface of said body and spaced from said opposite end by said line of weakness;
- wherein, when said cartridge is to be used in a grease gun as hereinbefore defined, said slidable seal can be pulled out of said body and said wall removed by cutting along said line of weakness to allow dispensing of said substance, said flange supporting said cartridge in a cylinder of the grease gun; and
- when said cartridge is to be used in a caulking gun as hereinbefore defined, said nipple can be cut and pressure applied to said slidable seal by a trigger actuated plunger of the caulking gun to force said substance out of said body through said nipple; and
- when said cartridge is to be used in a vacuum gun as hereinbefore defined, said nipple can be cut and screwed into an opening of a lever actuated vacuum mechanism of vacuum device which, on operation sucks said substance from said body with said slidable seal sliding along an inside surface of said body to maintain a seal therewith.

Preferably said line of weakness comprises a band of reduced thickness formed in the material of said body.

Preferably said band is in the form of a channel having a pair of spaced apart parallel walls and a base extending between said parallel walls.

Preferably, said means protruding radially from said outer circumferential surface of said body comprises a flange.

Preferably the flange is formed integrally with the one of the spaced apart walls most distant said nipple.

Preferably said slidable seal is provided with gripping means which a person can manually grip to pull said plate from said body.

Preferably said gripping means comprises a ring formed integrally with said slidable seal.

Preferably the pull ring is attached to one end of a tear strip formed integrally with the slidable seal and adapted to tear away from the slidable seal when the ring is pulled to form a hole in the slidable seal to expose the inside of the body, between the seal and the substance, to atmospheric pressure.

Preferably said body is provided with a longitudinal extending transparent or translucent strip through which the position of said plate can be viewed.

BRIEF DESCRIPTION OF THE DRAWINGS

Embodiments of the present invention will now be described by way of example only with reference to the accompanying drawings in which.

DETAILED DESCRIPTION OF PREFERRED EMBODIMENTS

Figure 1:
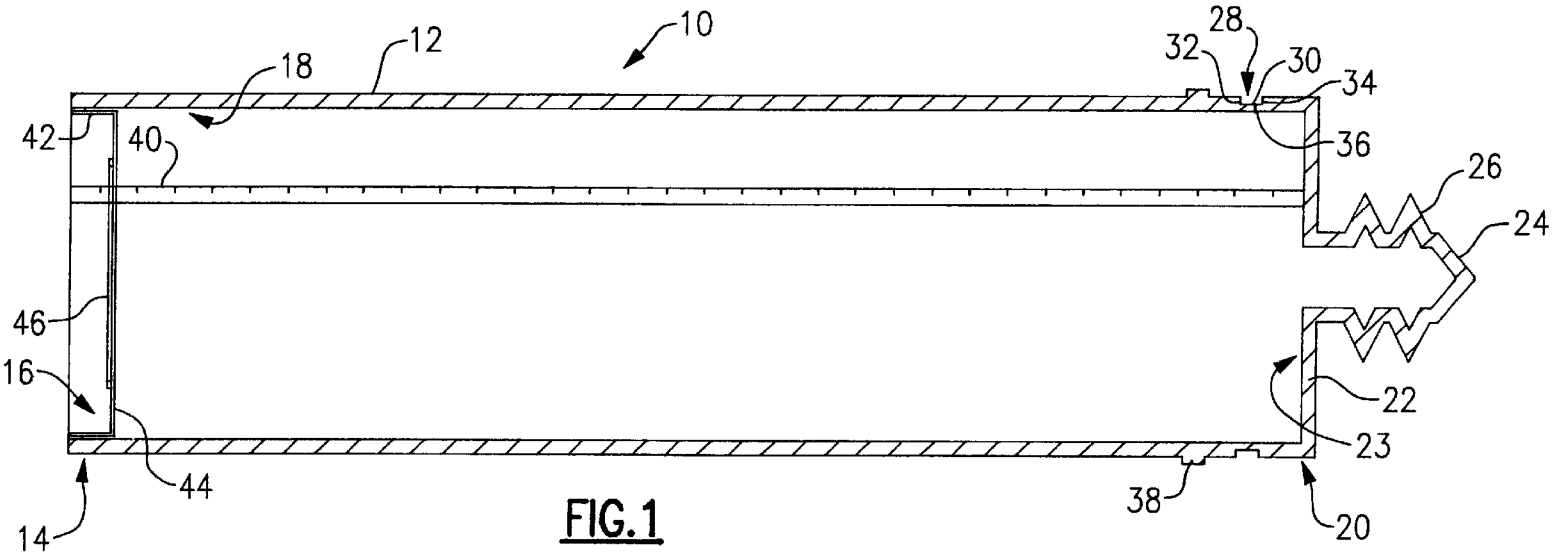
FIG. 1 is a longitudinal section view through a cartridge in accordance with a first embodiment of the present invention.

Referring to FIG. 1, the cartridge 10 for holding a supply of a flowable substance such as grease comprises a hollow elongate body in the form of a cylindrical tube 12 which is closed at one end 14 by a slidable seal 16. The slidable seal 16 fits inside the tube 12 and forms a seal about its periphery with inside surface 18 of the tube 12. The slidable seal 16 is able to slide along the length of the tube 12.

Opposite end 20 of the tube 12 is closed by an integral end wall 22. Sealed nipple 24 extends outwardly from the center of the end wall 22 and provides an opening, when cut, for the dispensing of the substance held within the tube 12. The nipple 24 is provided with an external thread 26 which can engage either a nozzle (not shown) which can be used to limit the rate of dispensing of the substance; or, the thread 26 can be engaged in a dispensing gun such as a REINER vacuum gun.

Figure 1A:
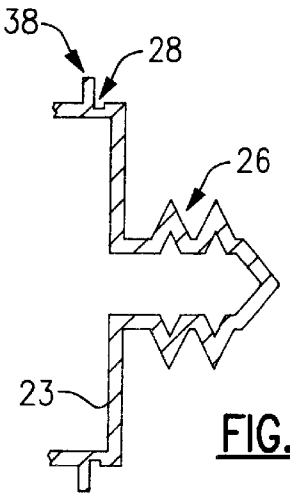
FIG. 1*a* is a front portion of a longitudinal section of a second embodiment of the cartridge; and, FIG. 2 is a plan view of a plate incorporated in the cartridge shown in FIG. 1.

A line of weakness 28 is formed about the tube 12 near the end wall 22. The line of weakness 28 is in the form of a "square U" channel 30 having a pair of spaced apart parallel walls 32 and 34 which are joined by a base 36 extending therebetween. In FIG. 1, the line of weakness is shown spaced a small distance back from end wall 22. However, in practice to minimise wastage of the contents of the cartridge 10, the line of weakness would preferably be very close to or immediately adjacent inside surface 23 of wall 22 as shown in FIG. 1*a*. In this way, if the end wall 22 is removed by cutting through the line 28 the cutting implement will scrape or come very close to scraping inside surface 23, thus minimising loss or wastage of the contents.

Means, in the form of a flange 38 is formed about and protrudes radially from the outer circumferential surface the tube 12. The flange is near the end wall 22 but spaced therefrom by the channel 30. Advantageously as shown in FIG. 1*a*, the flange 38 may be immediately adjacent the channel 30 so that the side of the flange nearest wall 22 is coplanar with side wall 32.

A translucent strip 40 is formed along the length of the tube 12 from end wall 22 to end 14. The purpose of the strip 40 is to allow viewing of the position of the slidable seal 16 within the tube 12. To assist in this, the slidable seal 16 may be made of a bright color or at least a contrasting color to that of the substance held within the tube 12. Additionally a scale can be marked along the strip 40 to allow measured dispensing of the substance held in the tube 12.

Figure 2:
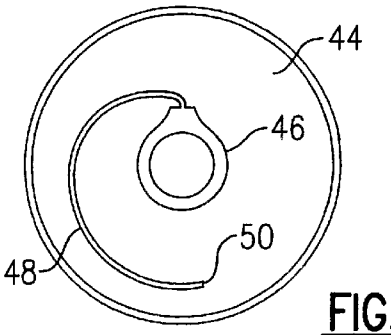

Slidable seal 16 is typically in the form of a shallow cup having a circumferential side wall 42 which is in sealing contact with the inside surface 18 of tube 12. Base 44 of the slidable seal 16 is in the form of a disc formed integrally with the circumferential wall 42. The slidable seal 16 is orientated so that the volume of shallow cup is accessible from outside the tube 12. A gripping means in the form of a pull ring 46 (refer FIG. 2) is formed on the base 44. Pull ring 46 can be attached to one end of a tear strip 48 which is formed integrally with the base 44. An opposite end 50 of the tear strip 48 is fixed to the base 44. When the ring 46 is pulled tear strip 48 is torn away from the base 44 leaving a hole therein, but remains attached to the base 44 at point 50. The tear strip 48 is of the same thickness of the base 44 and therefore when torn away the inside of body 16 is exposed to atmospheric pressure and the seal is broken. Thus, the only force required on pull ring 46 to remove the slidable seal 16 is that required to overcome the friction between the circumferential wall 42 and inside wall 18. One does not need to exceed any other sealing pressure or force within the tube 12.

When the cartridge 10 is to be used in a caulking gun as hereinbefore defined, the cartridge 10 is dropped into the caulking gun and the end of nipple 24 cut off. A nozzle (not shown) can then be screwed onto the nipple 24 to assist in controlling the flow rate of the substance and to also aid in the application of the substance to the work piece at hand. The trigger actuated plunger of the caulking gun is received by slidable seal 16 and bears against the base 44. By actuation of the trigger the plunger is progressed down the tube 12 pushing the slidable seal 16 with it and thus pushing the substance within the tube 12 out through the nipple 24 and nozzle.

When it is desired to use the cartridge 10 in a grease gun as hereinbefore defined, the slidable seal 16 is removed by pulling on the ring 46 and the end wall 22 is removed by cutting along the channel 30. The cutting should be performed by a sharp knife rather than a saw such as a hacksaw. The reason for this is to eliminate the formation of small cuttings or crumbs which can mix with the substance being dispensed and enter the apparatus or workpiece into which the substance is being injected. Indeed, because of the existence of the cut line the need for using a hacksaw is essentially eliminated because the wall thickness is such that a knife can easily penetrate and cut the tube 12. Hacksaws typically would be required when the thickness of the wall of the tube 12 has not been reduced. Further, the channel 30/line of weakness 28 ensures that the end wall 22 is cut-off square. This will facilitate the easy assembly of the grease gun. The flange 38 in this configuration is supported on the end of the cylinder portion of the grease gun which receives the screw dispensing cap thus preventing the tube 12 from dropping any further down. This ensures that once the grease has been dispensed the tube 12 can be easily removed.

When it is desired to use the cartridge 10 in a vacuum gun, as hereinbefore defined, such as a REINER gun, the end of nipple 24 is cut off and thread 26 engaged with the thread of the REINER gun. Levers on the REINER gun can then be pumped to create a vacuum which sucks the contents through the nipple 24. As this occurs, the slidable seal 16 is drawn further down the tube 12. In the REINER gun, the cartridge 10 is substantially supported by the nipple 24. It is therefore recommended that the line of weakness 28 not be so weak as to allow the end wall 22 to become separated from the remainder of the tube 12 when the cartridge 10 is supported by the nipple 24.

In both the vacuum gun and the caulking gun, substantially the whole length of at least a sector the tube 12 can be viewed. Provided the cartridge 10 is orientated so that the translucent strip 40 is in a position that can be viewed, one will be able to observe the position of the slidable seal 16 within the tube 12. This will allow the user to accurately gauge the amount of substance remaining in the tube 12.

Now that an embodiment of the present invention has been described in detail it will be apparent to those skilled in the relevant arts that numerous modifications and variations may be made without departing from the basic inventive concepts. For example, the flange 38 can be replaced with a plurality of radially extending tabs which provide the same function as the flange 38. While the translucent strip 40 is not essential to the invention this function can be mimicked by forming the whole of the tube 12 from a translucent or transparent material. Further, the pull ring 46 can be dispensed with altogether and/or replaced with another mechanism which allows a slidable seal 16 to be removed from the tube 12. For example, the inside of the circumferential wall 44 can be provided with one or more detents which can be engaged by the blade of a screwdriver to allow the levering out of the slidable seal 16. All such modifications and variations are deemed to be within the scope of the present invention the nature of which is to be determined from the foregoing description and the appended claims.

The claims defining the invention are as follows:

1. A cartridge for holding a supply of a flowable substance, said cartridge adapted for use in a plurality of different dispensing devices which can force said substance from said cartridge, said cartridge including:

a hollow elongate body for containing a supply of a flowable substance;

a slidable seal fitted inside said body for sealing one end of said body, an opposite end of said body being closed by an integral wall;

a sealed nipple formed on said wall and through which said substance can flow when said nipple is cut;

a line of weakness formed about said body near said opposite end; and, means protruding radially from an outer circumferential surface of said body and spaced from said opposite end by said line of weakness;

wherein, when said cartridge is to be used in a grease gun, said slidable seal can be pulled out of said body and said wall removed by cutting along said line of weakness to allow dispensing of said substance, said flange supporting said cartridge in a cylinder of the grease gun; and when said cartridge is to be used in a caulking gun, said nipple can be cut and pressure applied to said slidable seal by a trigger actuated plunger of the chalking gun to force said substance out of said body through said nipple; and when said cartridge is to be used in a vacuum gun, said nipple can be cut screwed into an opening of a lever actuated vacuum mechanism of vacuum device which, on operation sucks said substance from said body with said slidable seal sliding along an inside surface of said body to maintain a seal therewith.

2. A cartridge according to claim 1 wherein said line of weakness includes a band of reduced thickness formed in the material of said body.

3. A cartridge according to claim 2 wherein said band is in the form of a channel having a pair of spaced apart parallel walls and a base extending between said parallel walls.

4. A cartridge according to claim 3 wherein said means protruding radially from said outer circumferential surface of said body is a flange.

5. A cartridge according to claim 4 wherein said flange is formed integrally with the one of the spaced apart walls most distant said nipple.

6. A cartridge according to claim 1 wherein said slidable seal is provided with gripping means which a person can manually grip to pull said plate from said body.

7. A cartridge according to claim 5 wherein said gripping means comprises a ring formed integrally with said slidable seal.

8. A cartridge according to claim 7 wherein the pull ring is attached to one end of a tear strip formed integrally with the slidable seal and adapted to tear away from the slidable seal when the ring is pulled to form a hole in the slidable seal to expose the inside of the body, between the seal and the substance, to atmospheric pressure.

9. A cartridge according to claim 1 wherein said body is provided with a longitudinal extending transparent or translucent strip through which the position of said slidable seal can be viewed.

10. A cartridge according to claim 9 wherein markings are provided along said strip to facilitate measured dispensing of said substance.

* * * * *